US006822611B1

(12) United States Patent
Kontogeorgakis et al.

(10) Patent No.: US 6,822,611 B1
(45) Date of Patent: Nov. 23, 2004

(54) WIDEBAND INTERNAL ANTENNA FOR COMMUNICATION DEVICE

(75) Inventors: Christos Kontogeorgakis, Delray Beach, FL (US); Lorenzo A. Ponce De Leon, Lake Worth, FL (US); Robert A. Kroegel, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/431,740

(22) Filed: May 8, 2003

(51) Int. Cl.[7] ..... H01Q 1/24
(52) U.S. Cl. ..... 343/702; 343/767
(58) Field of Search ..... 343/702, 767; 455/575.7

(56) References Cited

U.S. PATENT DOCUMENTS 4,123,756 A 10/1978 Nagata et al.
4,389,651 A 6/1983 Tomasky
5,337,065 A 8/1994 Bonnet et al.
5,572,223 A 11/1996 Phillips et al.
5,943,020 A 8/1999 Liebendoerfer et al.
6,271,794 B1 * 8/2001 Geeraert ..... 343/700 MS
6,384,790 B2 5/2002 Dishart et al.

* cited by examiner

*Primary Examiner*—Michael C. Wimer
(74) *Attorney, Agent, or Firm*—Randall S. Vaas; Matthew C. Loppnow

(57) ABSTRACT

A multi-frequency internal antenna apparatus (10) for a clamshell type electronic device includes a flexible circuit (20) that electrically couples circuitry between the main housing (12) and flip housing (14). A conductive element (36) is disposed on the main housing (12) and tuned to be electrically resonant above the operating frequencies of the electronic device. The conductive element (36) is disposed in proximity to the flip housing (14) in the open position and is electrically coupled at a high impedance point to the flexible circuit (20) and subsequently to the circuitry in the flip housing. When the movable flip housing is in the open position and being held by a user, the circuitry in the movable flip housing forms a secondary conductive element providing dipole characteristics that tunes the combined conductive elements to the operating frequencies of the electronic device.

16 Claims, 6 Drawing Sheets

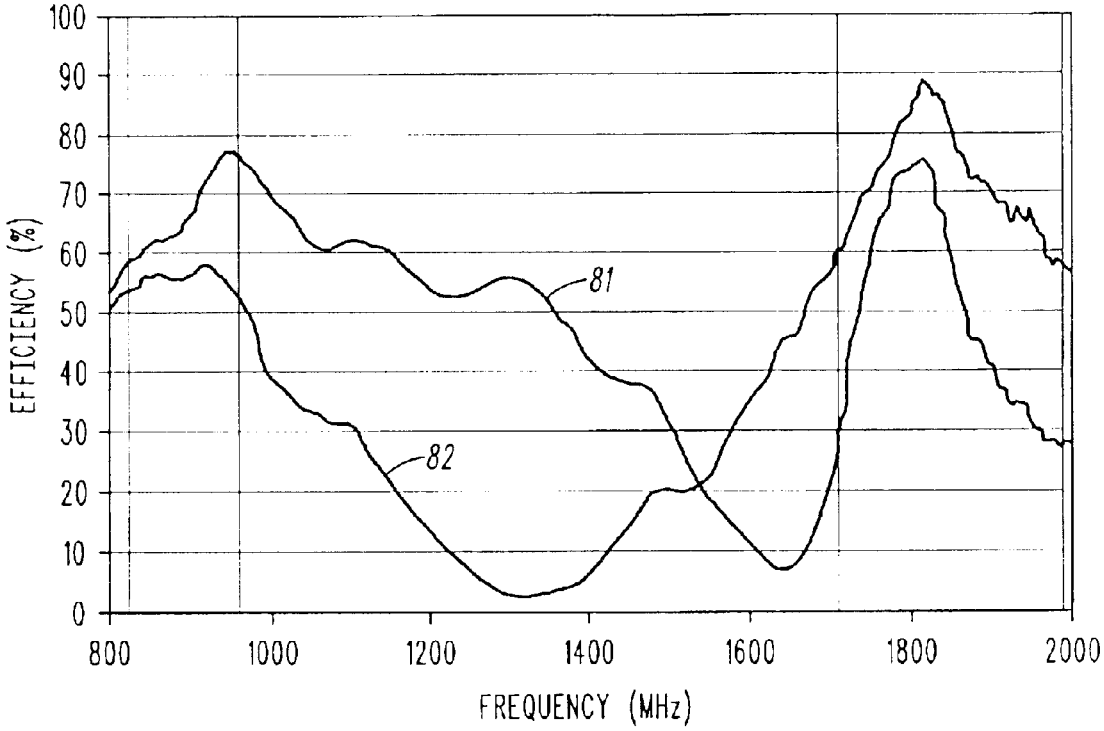
FIG. 8
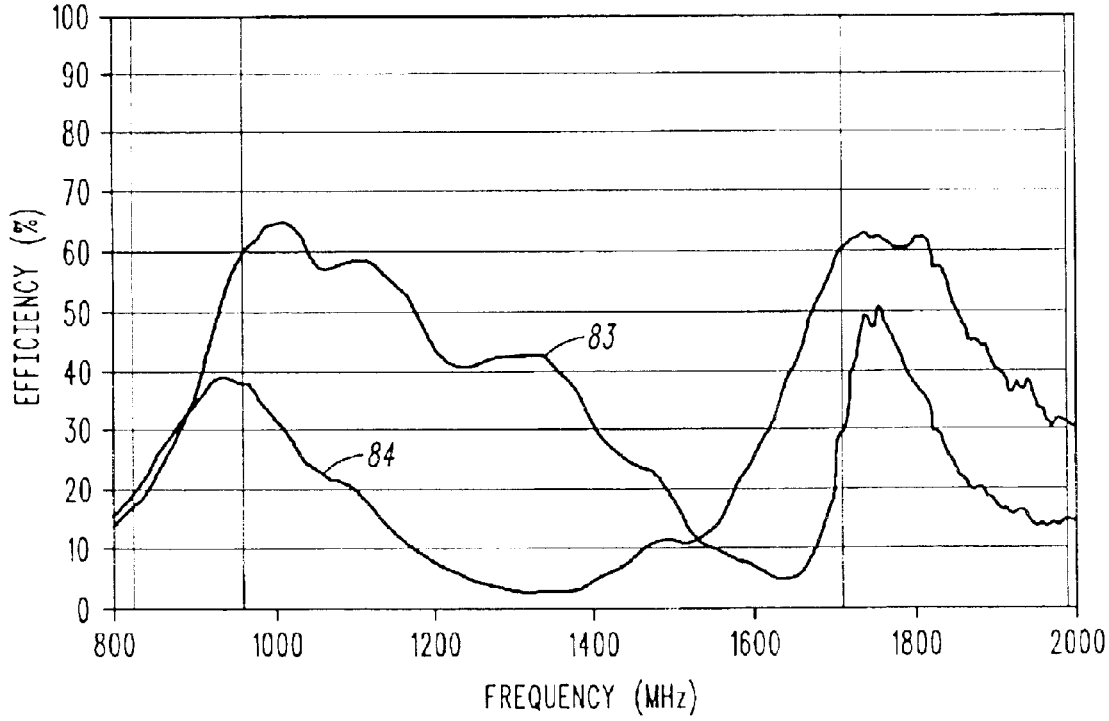

WIDEBAND INTERNAL ANTENNA FOR COMMUNICATION DEVICE

FIELD OF THE INVENTION

The present invention is related to an antenna, and more particularly to an antenna adapted to operate internally in an electronic device.

BACKGROUND OF THE INVENTION

The size of wireless handheld communication devices, such as cellular telephones, is being driven by the marketplace towards smaller and smaller sizes. Consumer and user demand has continued to push a dramatic reduction in the size of communication devices. As these devices become less bulky, users face an increasing number of options for carrying and using the device. For example, portable devices are thin and light enough to be easily carried in a shirt pocket. However, the antennas of such devices, when implemented externally to the device, are prone to damage. Therefore, internal antennas have been developed. However, such internal antenna systems still need to properly operate over multiple frequency bands and with various existing cellular system operating modes. In many cases, network operators providing services on one particular band have had to provide service on a separate band to accommodate its customers. For example, network operators providing service on the DAMPS communication system at 800 MHz and Global System of Mobile (GSM) communication system in a 900 MHz frequency band have had to also rely on operating on the Digital Communication System (DCS) at an 1800 MHz frequency band. Accordingly, wireless communication devices, such as cellular radiotelephones, must be able to communicate at these frequencies, or possibly a fourth frequency spectrum, such as the Personal Communication System (PCS) 1900 MHz. Moreover, in order to operate efficiently, internal antennas require a certain amount of mechanical space to be placed within the device, which becomes difficult with the shrinking geometry of portable devices.

Another serious problem arises in small devices when a user holds the device in their hands, and subsequently over the antenna, which severely degrades antenna efficiency. An extendable antenna shaft would solve part of the problem and provide improved efficiency for the communication device to properly operate at various frequencies. Unfortunately, extendable antennas are still relatively bulky when considering a phone that will possibly be reduced to a credit-card size. In particular, keeping the antenna shaft mechanically rugged for a small phone would be difficult to achieve. Moreover, due to the existing and future size reductions of phones, any extendable or rigid antenna shaft would necessarily be prone to damage.

The need for enhanced operability of communication devices along with the drive to smaller sizes results in conflicting technical requirements for the antenna. Different operational parameters dictate different antenna solutions and implementation schemes for different operating modes. In addition, consumers do not want to operate extendable antennas and do not want a phone prone to damage. In particular, external antennas are susceptible to flex stresses that can occur when carrying the device in a wallet, purse, pants pocket or shirt pocket during even mild user activities such as bending, walking, and sitting.

A recent solution has been to enclose the antenna completely within the housing of the communication device.

However, this has required making the device housing larger to accommodate the antenna. Further, the antenna has been located closer to the electronics of the device. As a result, size has increased, efficiency has decreased, and interference has become an issue. Moreover, the requirement to operate at two or more frequencies creates further problems.

Accordingly, there is a need for an internal antenna system that is not prone to damage, does not significantly increase the size of the communication device, and is not located next to the electronics of the communication device. It would also be advantageous to provide the antenna structure in a compact, low-cost implementation structure. Further, it would be of benefit to provide multi-frequency operation of the antenna.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

FIG. 8 is a graphical representation of a flip-open versus flip-closed efficiency performance of the embodiment of FIGS. 1 and 4.

DETAILED DESCRIPTION OF THE PREFERRED EMBODIMENTS

The present invention provides an antenna that is located on a housing of a clamshell type communication device making the antenna less prone to damage. The antenna is painted onto (conformal with) the housing taking little or no internal room from the device, and therefore does not significantly increase the size of the communication device due to its extremely low volume implementation. The present invention can be modified to provide two-band operation or multiple band operation with the addition of further components.

The present invention is an antenna adapted to receive signals in multiple frequency bands using one or more antennas with slots. In its feed configuration and shape, the present invention resembles a planar inverted F-antenna (PIFA), but unlike the PIFA, the present invention provides a much wider bandwidth (particularly around the 800/900 MHz bands which have been problematic) and performs much better under "severe" user antenna handling.

Figure 1:
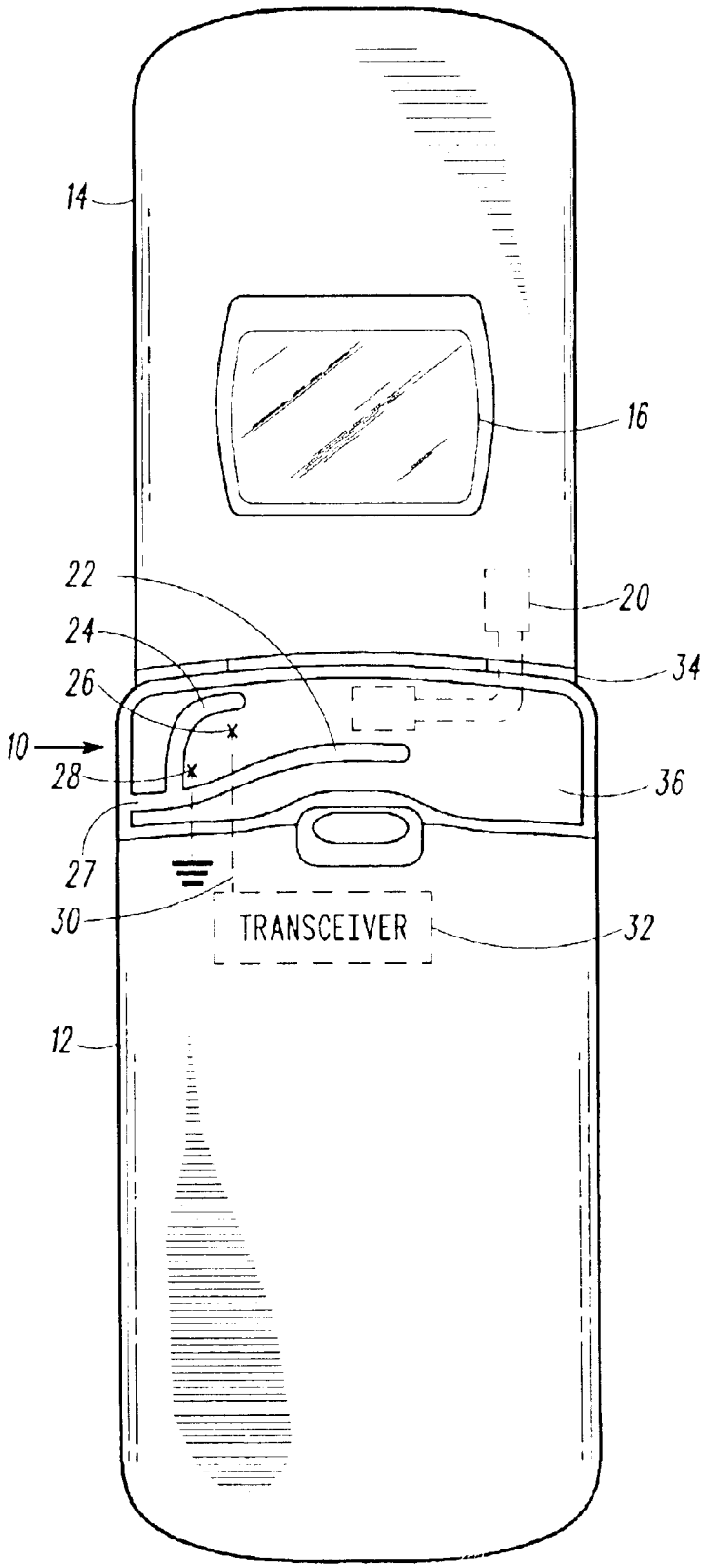
FIG. 1 is a rear view of an electronic device with a dual band embodiment of an antenna apparatus, in according with the present invention.

Turning to FIG. 1, a physical embodiment of an antenna apparatus 10 is shown in an electronic device such as a radiotelephone, in accordance with the present invention. The electronic device includes a main housing 12 and a movable flip housing 14, although these distinctions can be reversed without affecting the invention. The electronic device can include a user interface that includes one or more of a display 16, and a microphone, keypad, and speaker (all not shown) as are known in the art. In addition, a radio frequency (RF) connection 30 is made from a transceiver module 32 to the antenna apparatus 10. The transceiver module 32 includes a receiver or transceiver circuitry disposed therein and can be contained within the main housing 12 or optionally the movable housing 14. A hinge assembly 34 mechanically couples the main housing 12 and movable flip housing 14. A flexible interconnect circuit 20 is used to connect circuitry, such as circuit boards or circuit modules, between the main housing 12 and movable flip housing 14. The movable housing 14 has an open position (as shown) being hinged away from the main housing 12 and a closed position being in proximity to the main housing.

A conductive element 36 is disposed on the main housing 12. The conductive element 36 can be disposed on an outside of the main housing 12 (as shown), or alternatively on an inside of the main housing 14 or within the housing material itself. Of course, the main housing of the device, at least in proximity to the antenna apparatus, is necessarily non-conductive, such as being made out of a plastic. A first portion of the conductive element is tuned or configured to be electrically resonant at or above one operating frequency of the electronic device, as will be explained below. The conductive element 36 provides a first resonance due to a gap in the first portion of the element forming a first antenna 22 with a slot that is driven between a feed point 26 and ground 28 to provide the first resonance (e.g. 800/900 MHz).

A novel aspect of the present invention has the conductive element 36 disposed in proximity to the movable flip housing in the open position to improve performance. In particular, the conductive element 36 is electrically coupled to the flexible circuit 20 and subsequently to the circuitry in the movable flip housing such that when the movable flip housing is in the open position the circuitry in the movable flip housing and the flex circuit forms a secondary conductive element providing dipole characteristics. Specifically, a portion of the flexible circuit 20 is located within the main housing 12 underneath the conductive element 36 substantially near a high impedance point of the conductive element 36, which induces capacitive coupling to metal surfaces in its proximity. The portion of the flexible circuit 20 has a surface wide enough and substantially parallel to couple to the metallized surface (conductive element) of the housing. There are connection lines that run through the flexible circuit and connect to the chassis of the flip housing, including a display and/or other metallic parts in the flip housing. These connection lines augment the radiation mechanism of the antenna system as described above. Specifically, the surface of the flex connector couples to the antenna (under a high impedance area) and RF currents flow through the wires, including a ground wire that connects to the flip chassis. This coupling makes the radiotelephone device operate as a dipole near the first frequency band of about 800/900 MHz widening the frequency coverage, e.g. at 824–960 MHz the circuitry in the flip housing and base housing have lengths (approximately 85 mm) close to quarter-wavelength of the operating frequencies (78.1 to 91.0 mm). This coupling, in conjunction with the loading due to being held by a user, tunes the conductive element with the flexible circuitry coupling to a desired operating frequency band of the electronic device.

In its simplest, form the present invention can provide a single antenna (i.e. antenna with a single slot) for operating the electronic device. However, the trend in radiotelephone devices is for operation at multiple bands and/or multiple frequencies. For example, the electronic device can be required to transmit and receive signals in the DCS band (1710–1880 MHz frequencies) and the PCS band (1850–1990 MHz frequencies), while also having the capability to transmit and receive signals in the GSM band (880–960 MHz frequencies). This typically requires an antenna apparatus with more than one operating frequency, requiring more than one antenna element. Therefore, it is preferred that the conductive element 36 is also resonant at a second operating frequency of the electronic device. This is accomplished by having the conductive element 36 provide a second resonance due to a gap in the element forming a second antenna 24 with a slot that is driven between a feed point 26 and ground 28 to provide the second resonance (e.g. 1800/1900 MHz), Referring to FIG. 1, an antenna apparatus with a dual-slot is shown, operable on two or more different frequencies. Specifically. The slots of the two antennas 22, 24 are commonly coupled to a common slot 27. A common feed point 26 is connected to the conductive element 36 between the slots 22, 24 near the junction of the slots. A ground connection 28 is connected near the common slot opening 27 of the slots of the antennas 22, 24 of the conductive element 36, In general, the two or more operating frequencies are chosen to have substantially non-overlapping frequency bands. However, the two or more frequencies can be the same or close to each other to provide a wider bandwidth than is available with a single antenna element.

In practice, the top, rear (outside) portion of a plastic main housing of a clamshell phone is painted with metal (e.g. copper) to form the conductive element. Alternatively, stamped metal can be used that conforms to the shape of the housing (on either inside or outside of the housing). This area of the antenna apparatus covers about 44 mm by 20 mm. There is one feed connection 26 and one ground connection 28 between the printed circuit board of the device and the metallic paint separated by 5 to 8 mm distance. The antenna, for the low frequency, is tuned by creating a slot in the paint, creating an opening close to the side of the ground connector. The longer the slot the lower the frequency (800/900 MHz) achieved within limits). This structure can be made dual-band by creating a second slot/opening, on the other side of the ground connector, shorter this time, to cover the 1800/1900 MHz bands. In addition, the metallic paint is made to extend around the side of the plastic housing to increase its electrical length for this frequency range. A portion of the metallic paint is also located directly above the flexible circuit that connects to the flip and uses this proximity to couple with flip and increase the radiation efficiency of the antenna apparatus, as described previously. In particular, the antenna couples through the flex inside the phone to couple to the flip circuitry, as a secondary radiator, thus providing dipole characteristics to its behavior; high efficiency, wider bandwidth, and lower volume requirements from the main antenna.

It is not necessary to implement the antenna structure by painting on the outside of the plastics if there is enough antenna volume provided inside the housing. The antenna can be conformal (printed metallic) to the outside of the housing of the phone and make use of the extra volume that the plastics occupy under its area, as well as avoid any problems of plastic indentations commonly found inside the housing. In this way, the air space occupied inside the phone is about 2.9 cc while its real volume (including the plastics) is about 4.1 cc, still much smaller than a typical PIFA of 6 to 8 cc. This means that, provided this volume is given, the antenna does not necessarily need to be printed on the outside of the plastics, which is a more complicated and more expensive process.

Figure 2:
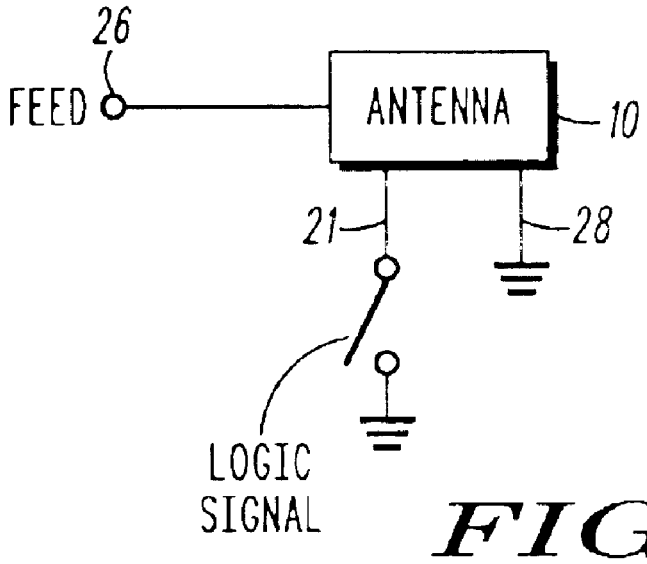
FIG. 2 is a simplified schematic view for a first quad band embodiment of the antenna apparatus of FIG. 1.

FIG. 2 shows a quad band embodiment of the present invention. Wide bandwidth is difficult to achieve in both the 1800 and 1900 MHz bands. Therefore, the antenna apparatus of FIG. 1 is coupled with a second, switchable shunt ground 21 connection for the conductive element that provides third and fourth operating frequencies of the electronic device depending on whether the switch is connected or disconnected. In particular, with the switch closed (second ground connected), the antenna apparatus is effective to provide an 1800 MHz frequency band as well the 800 and 900 MHz first and second frequencies. With the switch open (second ground disconnected), the antenna apparatus is effective to provide a fourth, 1900 MHz frequency band, although performance in the 800/900/1800 MHz bands is affected. The switch can be accomplished using a PIN diode. Although simpler to visualize this alternative is harder to implement since PIN diodes require a negative voltage to operate and need addition drive components.

Figure 3:
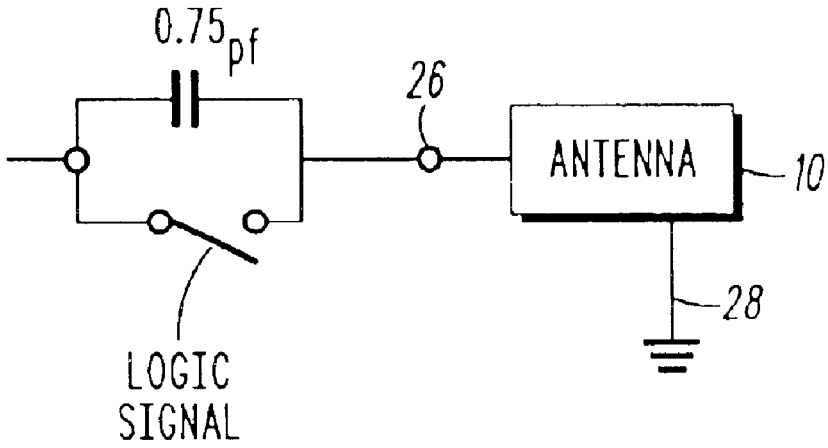
FIG. 3 is a simplified schematic view for a second quad band embodiment of the antenna apparatus of FIG. 1.

FIG. 3 shows a second quad band embodiment of the present invention, wherein the antenna apparatus of FIG. 1 is coupled with a series capacitor in parallel with a switch to drive the conductive element to provide third and fourth operating frequencies of the electronic device depending on whether the switch is connected or disconnected. In particular, with the switch closed (capacitor bypassed), the antenna apparatus is effective to provide an 1800 MHz frequency band as well the 800 and 900 MHz first and second frequencies. With the switch open (capacitor in circuit), the antenna apparatus is effective to provide a fourth, 1900 MHz frequency band. The switch can be accomplished using a GaAs SPST switch, which does not require a negative voltage and is simpler to implement, but with slightly more losses than the PIN diode embodiment of FIG. 2.

In practice, the antenna is coupled and matched to the circuitry of an electronic device as is known in the art. However, there are various other practical considerations to be made, as are known in the art. For example, the length and width of the slots affects efficiency and operating frequency. Therefore, the position and length and width dimensions of the conductive element and slots are preferably selected to optimize the efficiency of the antenna. That is, the size, position, length and width of the antenna devices are selected to provide the proper inductance or capacitance for the antenna, as are known in the art. Of course, many suitable dimensions for the frequency bands mentioned or other frequency bands could be used according to the present invention. Also in practice, if the antenna were disposed on the outside of the housing a protective covering, such as a non-conductive, UV-resistant paint could be applied over the antenna.

Figure 4:
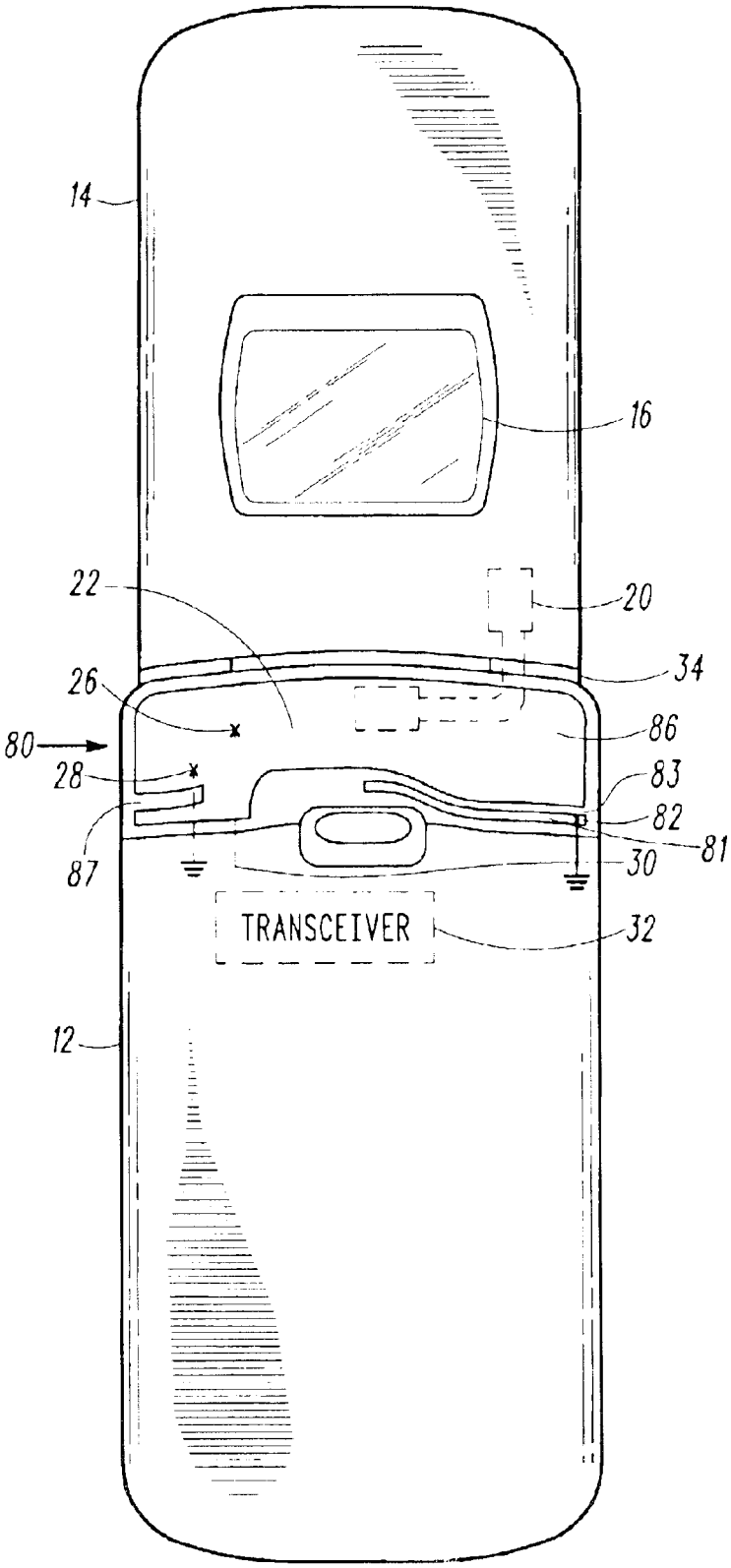
FIG. 4 is a rear view of an electronic device with a preferred quad band embodiment of an antenna apparatus, in accordance with the present invention.

Turning to FIG. 4, a physical embodiment of a preferred antenna apparatus 80 is shown in an electronic device such as a radiotelephone, in accordance with the present invention. The electronic device includes a main housing 12 and a movable flip housing 14 as before and can include a user interface that includes one or more of a display 16, microphone, keypad, and speaker (not shown) as are known in the art. In addition, a radio frequency (RF) connection 30 is made from a transceiver module 32 to the antenna apparatus 80, as before. A flexible interconnect circuit 20 is used to connect circuitry, such as circuit boards or circuit modules, between the main housing 12 and movable flip housing 14. The movable housing 14 has an open position (as shown) being hinged away from the main housing 12 and a closed position being in proximity to the main housing.

A conductive element 86 is disposed on the main housing 12 and a first portion thereof is tuned or configured to be electrically resonant above all of at least one operating frequency of the electronic device, as will be explained below. In this case, the conductive clement 86 provides a first resonance due to a foreshortened gap in the first portion of the element forming a first antenna 22 with a slot that is driven between a feed point 26 and ground 28 to provide the first resonance (e.g. 800/900 MHz).

The conductive element 86 is disposed in proximity to the movable flip housing in the open position to improve performance. In particular, the conductive clement 86 is electrically coupled to the flexible circuit 20 and subsequently to the circuitry in the movable flip housing such that when the movable flip housing is in the open position the circuitry in the movable flip housing and the flex circuit forms a secondary conductive element providing dipole characteristics. Specifically, a portion of the flexible circuit 20 is located within the main housing 12 underneath the conductive element 86 substantially near a high impedance point of the conductive element 86, which induces capacitive coupling to metal surfaces in its proximity. The portion of the flexible circuit 20 has a surface wide enough and substantially parallel to couple to the metallized surface (conductive element) of the housing. There are connection lines that run through the flexible circuit and connect to the chassis of the flip housing, including a display and/or other metallic parts in the flip housing. These connection lines augment the radiation mechanism of the antenna system as described above. Specifically, the surface of the flex connector couples to the antenna (under a high impedance area) and RF currents flow through the wires, including a ground wire that connects to the flip chassis. This coupling makes the radiotelephone device operate as a dipole in the 800/900 bands, e.g. at 824–960 MHz the circuitry in the flip housing and base housing have lengths (approximately 85 mm) close to quarter-wavelength of the operating frequencies (78.1 to 91.0 mm). This coupling, in conjunction with the loading due to being held by a user along with the presence of a parasitic ground resonator 81 (PGR) also near the high impedance point of the conductive element, tunes the conductive element with the flexible circuitry coupling to two desired operating frequency bands of the electronic device. The parasitic ground resonator 81 has an equivalent electrical length of about one-quarter wavelength in the PCS band, due to its coupling to the conductive element 86 and the presence of a second ground connection 82 at a far end. The PGR 81 adjusts the slot 87 frequency to create a quad-band antenna apparatus. The PGR 81 is separated by a coupling slot 83 near a high impedance portion of the conductive element 86 that is tunable to control coupling therebetween. The slot 87 can then be adjusted to optimize the DCS band unlike the first embodiment where the slot was tuned to the GSM band. The PGR 81 and conductive element can be formed using the same manufacturing process of disposing a metal file on a plastic housing.

In this preferred embodiment, the present invention provides a single antenna apparatus for operating the electronic device in the DCS band (1710–1880 MHz frequencies) and the PCS band (1850–1990 MHz frequencies), while also having the capability to transmit and receive signals in the GSM band (880–960 MHz frequencies).

EXAMPLE

Figure 5:
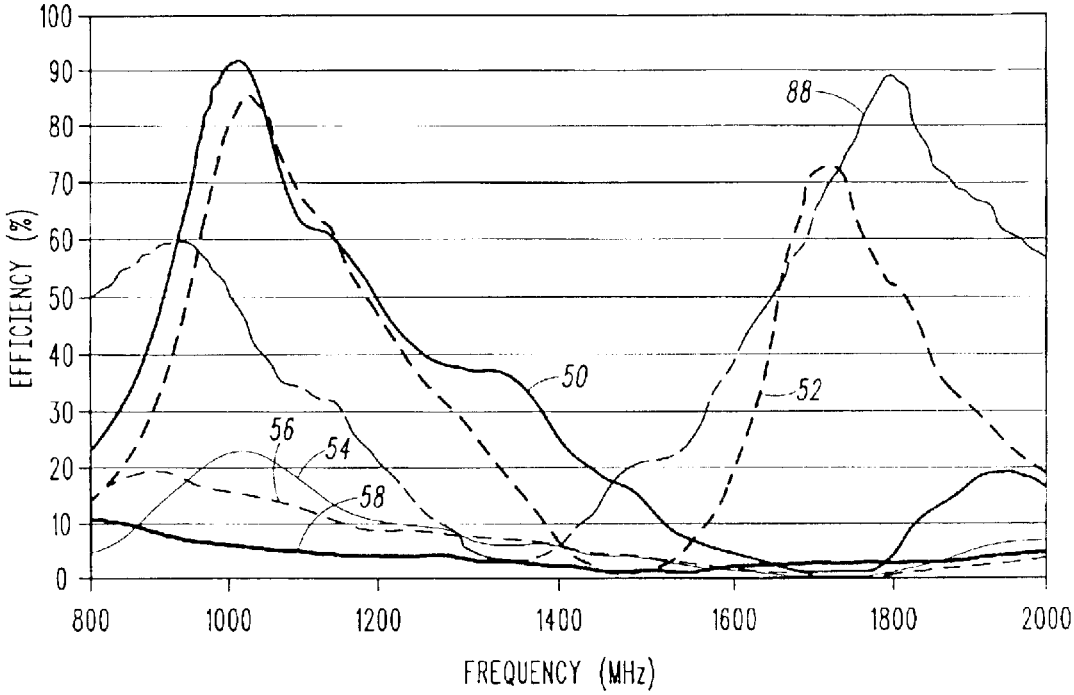
FIG. 5 is a graphical representation of a comparison of efficiency tests of the embodiments of FIG. 1 and FIG. 4.

A prototype antenna apparatus was constructed, in accordance with the single and dual band embodiments of FIGS. 1–3, and subjected to efficiency tests using commonly acknowledged testing techniques. FIG. 5 shows a comparison of the results of the tests of the antenna in regards to several testing parameters. The antenna was then tested free-field (with flip opened), with a phantom head placed next to the phone, with a phantom head and hand placed in a typical position that a user would use, with a phantom head and hand totally covering the phone. As can be seen, the free-field response 50 has an efficiency of over 90% near the 800/900 MHz band when the flip is open. With the flip closed, the efficiency decreases invariably. However, it is not uncommon to have this difference in performance in clamshell phones. In as much as a consumer wants proper communication when using the radiotelephone, it is considered more important to have the higher efficiency performance in the open position. However, in the closed position (not shown), the efficiency is still greater than 35%, which is quite acceptable. The response of the dual band version 52 shows slightly less efficiency and slightly narrower bandwidth. In either case, the performance is better than that of a comparable, commonly available "stubby" antenna. The test with the phantom head 54 shows an efficiency over 20% near the 800/900 MHz band, which is better than a "stubby" antenna in a similar test.

Most commonly, a radiotelephone is used with a consumer holding the device in their hand next to their head. In this user position, all radiotelephones experience a significant performance degradation (7–10 dB). At the low bands (800/900 MHz) in particular, the radiation source of the phone is not localized at the antenna itself, but more in the circuit board ground in the base housing, which is mostly responsible for signal radiation. By holding the phone (even away from the antenna itself), the hand covers most of the radiation source, leading to low efficiency. Of course, if the proximity of a user's hand to the antenna leads to mismatch, then additional losses are observed. In the present invention, however, the antenna is very "tolerant" of the hand's presence (no mismatch) and the measured performance is in fact superior to stubby antenna having a typical efficiency (in 800/900 MHz) of 2 to 8%. The test with the phantom head and hand 56 shows an efficiency of almost 20% in the 800/900 MHz band, much better than a "stubby" antenna in a similar test. Moreover, the dielectric of the hand "loads" the antenna and shifts the resonance to lower frequency. Hence, the free-field tuning of the antenna system is deliberately tuned a little higher than the 800/900 MHz band. This is the most typical use of the device, and it should be noticed that the frequency response falls on-band in this mode. The test with the phantom head and totally covering hand 58 still shows an efficiency of about 10%, which is better than a "stubby" antenna a typical number is 1 to 3%.

The preferred embodiment of the quad band antenna apparatus of FIG. 4 was also test, and is shown as curve 88. In this case, the slot and PGR (87 and 81 from FIG. 4, respectively) provide two closely-spaced operating frequencies to improve the high band frequency efficiency over a much wider band. The flex connection coupling in this embodiment now supports the GSM band, which can be seen to have a lower efficiency than in the first two embodiments, but still quite sufficient for proper operation in all four operating frequencies.

Figure 6:
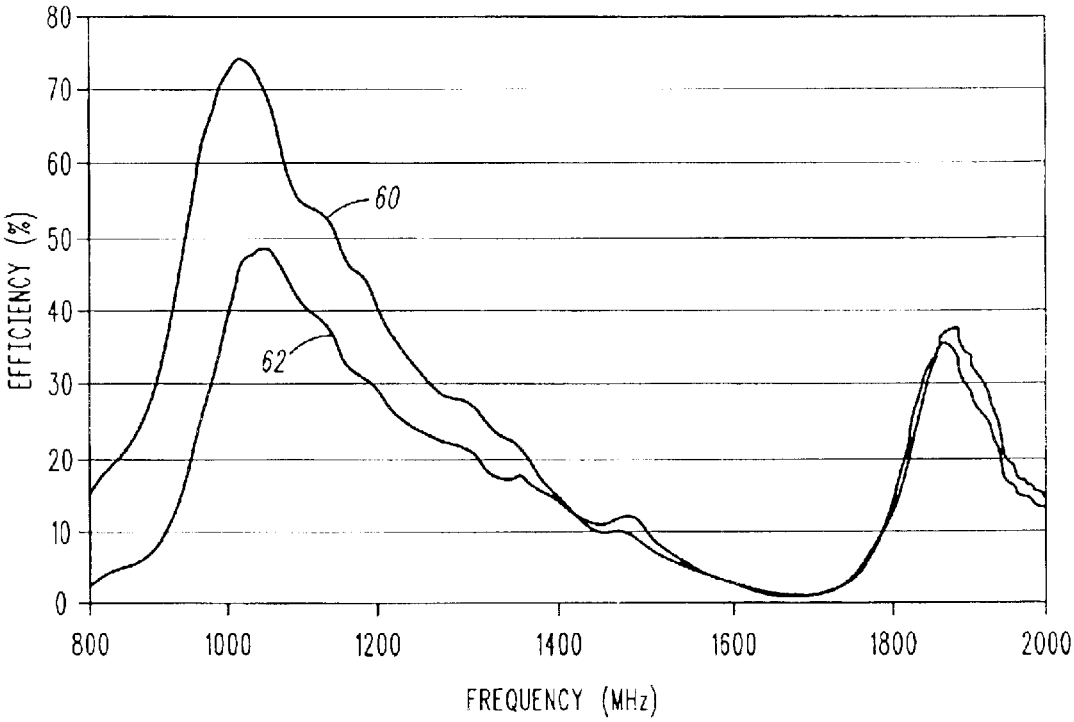
FIG. 6 is a graphical representation of a further efficiency test of the embodiment of FIG. 1.

FIG. 6 shows the further improvement provided by coupling of the antenna apparatus to the flexible circuit, tested using the dual band embodiment of the antenna apparatus of FIG. 1. As can be seen, coupling with the flexible circuit 60 further improves efficiency over the response without flexible circuit coupling 62 and shifts the frequency response to more closely cover the 800/900 MHz band.

Figure 7:
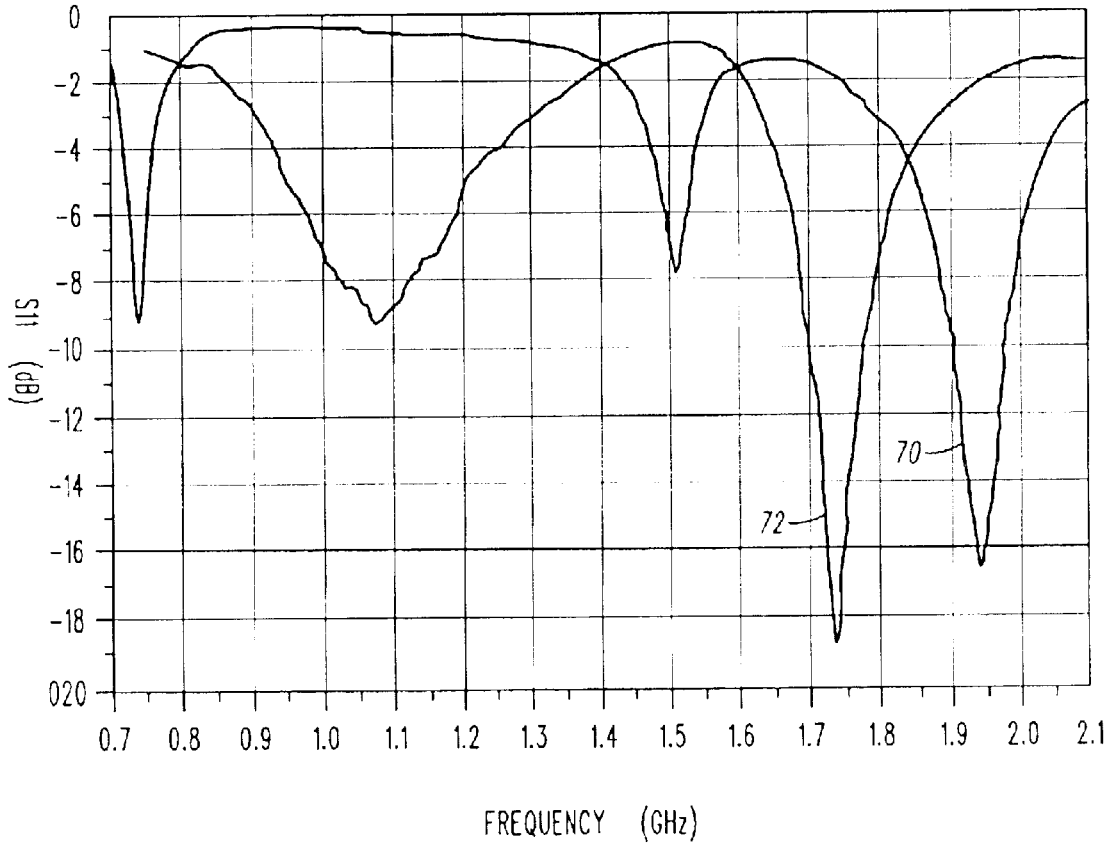
FIG. 7 is a graphical representation of a frequency-shifting test of the embodiment of FIGS. 2 and 3.

FIG. 7 shows a reflection coefficient test for the quad band antenna embodiments of FIGS. 2 and 3, with the switch switched in 70 and switched out 72. As can be seen, using the switch provides effective coverage for the PCS band (1850–1990 MHz frequencies).

FIG. 8 shows an efficiency of the antenna embodiments of FIGS. 1 and 4, when the flip is open versus when the flip is closed. Curves 81 and 83 show the case of the embodiment of FIG. 1 when the flip is opened and closed, respectively. As can be seen, efficiency improves when the flip is opened, which is desired. However, the efficiency when the flip is closed is also quite good and better than an equivalent stubby antenna. Similarly, curves 82 and 84 show the case of the embodiment of FIG. 4 when the flip is opened and closed, respectively. As can be seen, efficiency is again better when the flip is opened, which is desired. However, the higher frequency bandwidth is much larger which relieves this embodiment of the necessity of switching (as represented in FIG. 2 and 3) in order to cover all four bandwidths (800/900 and 1800/1900 MHz) with good efficiency. Although the lower band coverage is not as efficient as that of the embodiment of FIG. 1, it is still quite acceptable and better than an equivalent stubby antenna.

It should be recognized, that the flexible circuit that couples to form a dipole at the 800/900 MHz band can be replaced by any circuit or wire that couples to the antenna by having a portion in the flip housing to increase antenna performance when the flip is open. It is specifically desirable to have the flexible circuit or wire couple the antenna at a high impedance portion thereof to a ground portion within the flip housing.

In summary, the present disclosure is related to an internal, wideband antenna to operable for receiving or transmitting electrical signals in at least four frequency bands. Although the invention has been described and illustrated in the above description and drawings, it is understood that this description is by way of example only and that numerous changes and modifications can be made by those skilled in the art without departing from the broad scope of the invention. Although the present invention finds particular use in portable cellular radiotelephones, the invention could be applied to any wireless communication device, including pagers, electronic organizers, and computers. The invention should be limited only by the following claims.

What is claimed is:

1. An internal antenna apparatus for an electronic device having a main housing and a movable flip housing, the apparatus comprising:

a hinge assembly mechanically coupling the main housing and movable housing, the movable flip housing having an open position being hinged away from the main housing and a closed position being in proximity to the main housing;

a flexible circuit element electrically coupling circuitry in the main housing and circuitry in the movable flip housing; and a conductive element disposed on the main housing, the conductive element having a first portion tuned to provide an electrical resonance above an operating frequency of the electronic device, the conductive element is disposed in proximity to the movable flip housing in the open position and is electrically coupled to the flexible circuit element and subsequently to the circuitry in the movable flip housing such that when the movable flip housing is in the open position and being held by a user the circuitry in the movable flip housing forms a secondary conductive element providing dipole characteristics that tunes the combined conductive elements to the operating frequency of the electronic device.

2. The apparatus of claim 1, wherein the first portion of the conductive element is an antenna with a slot disposed on an outside of the main housing.

3. The apparatus of claim 1, wherein a portion of the flexible circuit element is located within the main housing and forms substantially parallel planes with the conductive element to provide capacitive coupling thereto.

4. The apparatus of claim 3, wherein the portion of the flexible circuit element is coupled substantially to a high impedance point of the conductive element.

5. The apparatus of claim 2, wherein the conductive element includes a second antenna with a slot being resonant at a second operating frequency of the electronic device.

6. The apparatus of claim 5, further comprising a series capacitor in parallel with a switch to drive the conductive element to provide either of third and fourth operating frequencies of the electronic device depending on whether the switch is connected or disconnected.

7. The apparatus of claim 5, further comprising a switchable second shunt ground connection for the conductive element to provide either of third and fourth operating frequencies of the electronic device depending on whether the switch is connected or disconnected.

8. The apparatus of claim 5, wherein the slots of the two antennas are commonly coupled to a common slot, and further comprising a feed point connected to the conductive element between the slots near the junction of the slots.

9. The apparatus of claim 1, further comprising a parasitic ground resonator having an electrical length of about one-quarter wavelength in the PCS band and coupled to the conductive element to extend an operating bandwidth of one of the operating frequency bands of the electronic device.

10. A multi-band internal antenna apparatus for an electronic device having a main housing and a movable flip housing, the apparatus comprising:

a hinge assembly mechanically coupling the main housing and movable housing, the movable flip housing having an open position being hinged away from the main housing and a closed position being in proximity to the main housing;

a flexible circuit element electrically coupling circuitry in the main housing and circuitry in the movable flip housing;

a conductive element including two antennas with two slots disposed on the main housing commonly coupled to a common slot and tuned to be electrically resonant above two operating frequencies of the electronic device, the conductive element is disposed in proximity to the movable flip housing in the open position and is electrically coupled at a high impedance point to the flexible circuit element and subsequently to the circuitry in the movable flip housing such that when the movable flip housing is in the open position and being held by a user the circuitry in the movable flip housing forms a secondary conductive element providing dipole characteristics that tunes the combined conductive elements to the dual operating frequencies of the electronic device;

a feed point connected to the conductive element between the two slots near the junction of the two slots; and a ground connection connected near the common slot opening of the conductive element.

11. The apparatus of claim 10, wherein one end of the flexible circuit element is located within the main housing and forms substantially parallel planes with the conductive element to provide capacitive coupling thereto.

12. The apparatus of claim 10, further comprising a series capacitor in parallel with a switch to drive the conductive element to provide either of third and fourth operating frequencies of the electronic device depending on whether the switch is connected or disconnected.

13. The apparatus of claim 10, further comprising a switchable second shunt ground connection for the conductive element to provide either of third and fourth operating frequencies of the electronic device depending on whether the switch is connected or disconnected.

14. A quad-band internal antenna apparatus for an electronic device having a main housing and a movable flip housing, the apparatus comprising:

a hinge assembly mechanically coupling the main housing and movable housing, the movable flip housing having an open position being hinged away from the main housing and a closed position being in proximity to the main housing;

a flexible circuit element electrically coupling circuitry in the main housing and circuitry in the movable flip housing, a conductive element including an antenna with a slot disposed on an outside of the main housing and tuned to be electrically resonant above a first operating frequency band of the electronic device, the conductive element is disposed in proximity to the movable flip housing in the open position and is electrically coupled at a high impedance point to the flexible circuit element and subsequently to the circuitry in the movable flip housing such that when the movable flip housing is in the open position and being held by a user the circuitry in the movable flip housing forms a secondary conductive element providing dipole characteristics that tunes the combined conductive elements to a second operating frequency band of the electronic device;

a parasitic ground resonator having an electrical length of about one-quarter wavelength near the first operating frequency band and coupled to the conductive element to extend an operating bandwidth of the first operating frequency band of the electronic device, the parasitic ground resonator is coupled to the conductive element near a high impedance point thereof;

a feed point connected to the conductive element to drive the conductive element; and a first ground connection connected near a common slot opening of the conductive element, and a second ground connection that grounds the parasitic ground resonator at an end away from the high impedance coupling point.

15. The apparatus of claim 14, wherein the conductive element and parasitic ground resonator are disposed on an outside of the main housing.

16. The apparatus of claim 14, wherein one end of the flexible circuit element is located within the main housing and forms substantially parallel planes with the conductive element to provide capacitive coupling thereto.

* * * * *